US006289622B1

(12) United States Patent
Desch, Jr. et al.

(10) Patent No.: US 6,289,622 B1
(45) Date of Patent: Sep. 18, 2001

(54) FIREARM STOCK WITH SUPPORT SYSTEM

(75) Inventors: Edward F. Desch, Jr., Bozeman; Thomas M. Gregory, Belgrade, both of MT (US); John M. French, Boise, ID (US)

(73) Assignee: Michaels of Oregon Co., Portland, OR (US)

( * ) Notice: Subject to any disclaimer, the term of this patent is extended or adjusted under 35 U.S.C. 154(b) by 0 days.

(21) Appl. No.: 09/337,931

(22) Filed: Jun. 22, 1999

(51) Int. Cl.[7] ..... F41A 9/62
(52) U.S. Cl. ..... 42/94
(58) Field of Search ..... 89/37.04; 42/94, 42/85, 72, 73

(56) References Cited

U.S. PATENT DOCUMENTS

| | | | | |
|---|---|---|---|---|
| 271,251 | * | 1/1883 | Leerbech et al. | 42/94 |
| 716,158 | * | 12/1902 | Wheeler | 42/94 |
| 2,330,637 | * | 9/1943 | Spagnolo | 42/86 |
| 2,441,487 | * | 5/1948 | Howard | 42/72 |
| 2,547,180 | * | 4/1951 | Taylor | 42/72 |
| 2,807,904 | * | 10/1957 | Kreske | 42/94 |
| 3,235,997 | * | 2/1966 | Stoner | 42/94 |
| 3,938,273 | * | 2/1976 | Tellie | 89/37.04 |
| 4,351,224 | * | 9/1982 | Curtis | 89/37.04 |
| 4,625,620 | * | 12/1986 | Harris | 89/37.04 |
| 4,788,785 | * | 12/1988 | White | 42/72 |
| 5,029,407 | * | 7/1991 | Kirkpatrick | 42/94 |
| 5,711,103 | * | 1/1998 | Keng | 89/37.04 |
| 5,852,892 | | 12/1998 | Bilgeri et al. | 42/94 |

FOREIGN PATENT DOCUMENTS

| | | | | |
|---|---|---|---|---|
| 494068 | * | 3/1930 | (DE) | 42/86 |

OTHER PUBLICATIONS

Cabelas catalog, p. 415, at least as early as Sep. 1, 1998.
Harris Engineering, Inc. advertisement, at least as early as Sep. 1, 1998.

* cited by examiner

*Primary Examiner*—Charles T. Jordan
*Assistant Examiner*—Denise J Buckley
(74) *Attorney, Agent, or Firm*—Chernoff Vilhauer McClung & Stenzel

(57) ABSTRACT

A firearm stock has a supporting system for use with a firearm. The stock supports a firearm barrel on an upper portion of the stock. The stock defines in a lower portion an elongate slot. At least one support is pivotally connected to the stock. The support is movable between a first position in which a majority of the support is located within the slot and a second position in which the supporting end of the support extends away from the stock so as to support the stock when using the firearm. In a preferred embodiment, the supporting system includes a second support pivotally connected to the stock and movable between the first position and the second position.

20 Claims, 4 Drawing Sheets

FIREARM STOCK WITH SUPPORT SYSTEM

BACKGROUND OF THE INVENTION

The present invention relates to a firearm stock having a supporting system for supporting the firearm, and more particularly to a firearm stock having a pivotable bipod.

Supporting systems for firearms, such as shotguns, rifles, or pistols, are used to support a portion of the weight of the firearm. Shooting sticks and bipods are typical examples of supporting systems for firearms. Bipods typically consist of two legs which attach to the front portion of a firearm stock. A bipod may attach directly to the exterior of the firearm barrel, or may attach to a swivel stud mounted on the exterior of the stock. A bipod typically has extendable legs. The legs may pivot between a position flush with the exterior of the stock to a position extending approximately perpendicular to the stock to support the firearm. Examples of such bipods are the Harris Model 25 Bipod and the Harris Model 1 Bipod. Bipods may be used in connection with shooting firearm from a prone position, from a bench, or while sitting.

Traditional bipods typically have several problems. Traditional bipods have a tendency to interfere with use and storage of the firearm to which they are attached. For example, because bipods are attached to the exterior of the firearm, the bipods may catch on gun cases, brush, clothing, barbed-wire fences, etc. This can create a safety hazard, especially when the bipod is being used in connection with loaded firearms, for example, when hunting. In addition, traditional bipods are generally made of metal and are heavy, cumbersome structures. Such bipods are not aesthetically pleasing and detract from the appearance of the firearm. Traditional bipods also tend to generate noise during set-up, either when pivoting the legs to a supporting position or when extending the legs.

Traditional bipods also have a tendency to adversely affect the accuracy of the firearm. Bipods which are clamped to the exterior of a firearm barrel may produce pressure against the barrel, thus impairing the accuracy of the firearm. Moreover, movement of the bipod legs against the surface on which the legs rest in response to the recoil induced by firing the firearm can also diminish the accuracy of shooting.

Because supporting systems, such as bipods, must be carried into the field, they either must be attached to the exterior of the firearm or must be carried separately. When the bipod is separated from the firearm, the bipod may not be available for use when it is needed, particularly when hunting. The bipod may also be forgotten and left behind.

Finally, bipods in the past have been relatively complicated mechanical devices. These devices have many moving parts and springs, and often include clamping and pivoting mechanisms. Thus, the devices can often be difficult and costly to manufacture.

Accordingly, there is a need for a firearm having a supporting system that does not interfere with use or storage, is light weight, relatively quite in use, is aesthetically pleasing, does not impair shooting accuracy of the firearm, is easy to use, and is relatively easy and cost-effective to manufacture.

SUMMARY OF THE INVENTION

The present invention overcomes the drawbacks of the prior art by providing a firearm stock with a supporting system for use with a firearm. The stock supports a firearm barrel on an upper portion of the stock. The stock defines in a lower portion an elongate slot. At least one support is pivotally connected to the stock. The support is moveable between a first position in which a majority of the support is located within the slot, and a second position in which the supporting end of the support extends away from the stock so as to support the stock when using the firearm. In a preferred embodiment, the supporting system includes a second support pivotally connected to the stock and moveable between the first position and the second position.

The different aspects of the invention have one or more of the following advantages. Because the support can be retracted inside a slot in the stock, the supporting system does not interfere with use of the firearm by catching on gun cases, brush, clothing, barbed-wire, etc. The stock and supporting system may also be constructed of a light weight polymeric material. These materials may also provide a stock and supporting system which is relatively quiet when in use. Because the supporting system does not attach to the exterior of the firearm barrel, the supporting system does not impair the shooting accuracy of the firearm. The supporting system is easy to use, and because it is attached to the stock, is always available when needed. Further, the supporting system may be simply and cost-effectively manufactured.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figures 1, 2:
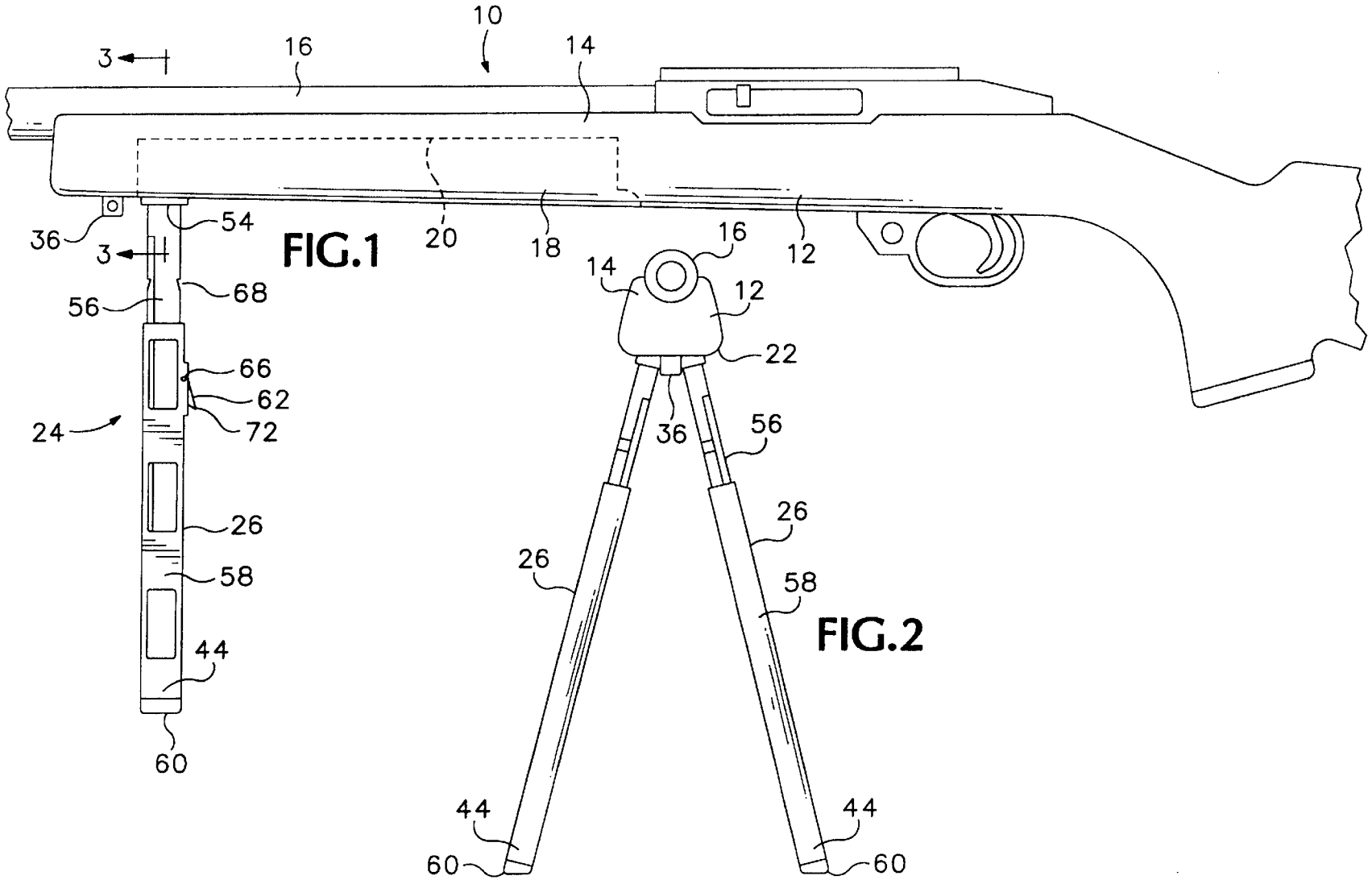
FIG. 1 is a side view of a portion of a firearm having an exemplary stock and supporting system of the present invention, showing the supports extending away from the stock.
FIG. 2 is a front view of the firearm of FIG. 1.

Referring now to the drawings, wherein like numerals refer to like elements, FIG. 1 shows a firearm 10 with a stock 12. The firearm may be any firearm, such as a rifle, shotgun, or pistol. The stock 12 has an upper portion 14 that supports a portion of the barrel 16. The barrel 16 may be any type of firearm barrel and the stock and barrel may be secured to each other in any conventional fashion.

The lower portion 18 of the stock 12 defines an elongate slot 20. The slot 20 is located on the opposite side of the stock 12 from the barrel 16. Preferably, the slot 20 is formed in the lower portion 18 of the stock 12 so as not to interfere with the curved exterior contoured surface 22 of the stock 12. The stock 12 therefore may be easily grasped and held in a shooter's hand, notwithstanding the presence of the slot 20 in the stock 12.

The stock 12 has a supporting system 24 that fits within the slot 20. In one preferred aspect of the invention, the supporting system 24 comprises two supports 26 which are each pivotally supported at one end of the slot 20. The supports 26 are sized so that a major portion of each of the supports 26 fits within the slot 20. Preferably, the width of the supports 26 are less than the depth of the slot 20 so that when the supports 26 are retracted, or pivoted within the slot 20, the supports 26 are completely housed within the slot 20 and do not protrude outside of the slot 20. Preferably, the supports 26 are sized so that the supports 26 are substantially flush with the exterior of the stock 12 when fully retracted within the slot 20. Nonetheless, other sized supports 26 may be used, and may be narrower or wider than the depth of the slot 20, so that a minor portion (i.e., less than half) of the supports 26 may protrude from the slot 20, or alternatively the supports 26 may be completely recessed within the slot 20 when fully retracted.

A pivot mechanism connects the supports 26 to the stock 12 so that the supports 26 may be pivoted between a first position (illustrated in FIGS. 4 and 5) in which the supports 26 are retracted within the slot 20, and a second position (illustrated in FIGS. 1 and 2) in which the supports 26 are extended away from the stock 12 to support the firearm 10. Thus, the supporting system 24 may be fully housed-within the stock 12 of the firearm 20 when not in use, but is nevertheless always available to use with the firearm 20 when needed. Because at least a majority of the supports 26 retracts within the slot 20, the supports 26 are less likely to interfere with use or storage of the firearm 10 by catching on storage cases, clothing, brush, etc.

Figure 3A:
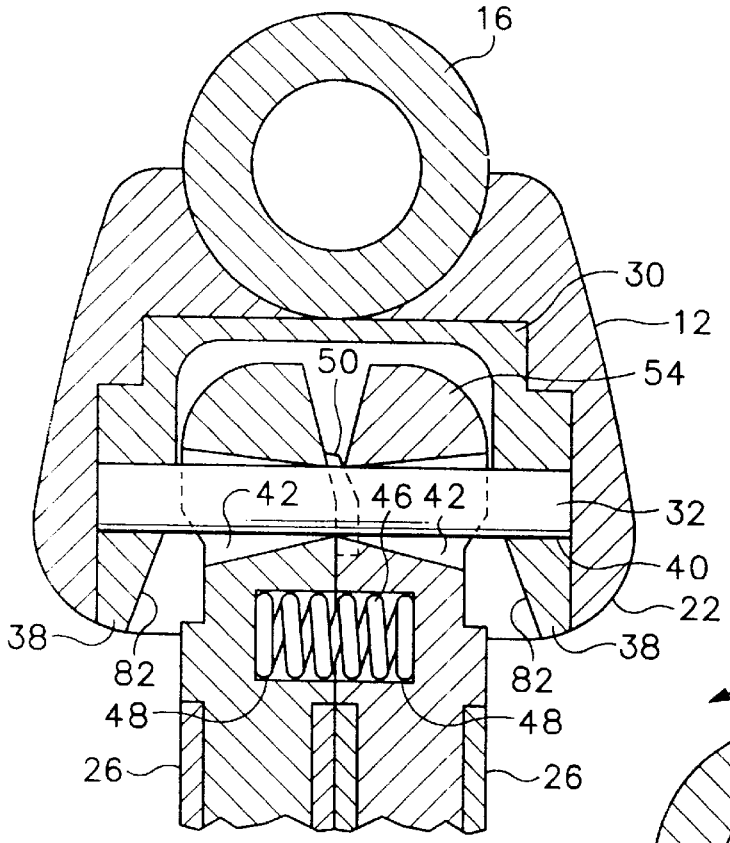
FIG. 3A is a cross sectional view taken along the line 3—3 of FIG. 1, in which the supports are pressed together.
Figure 3B:
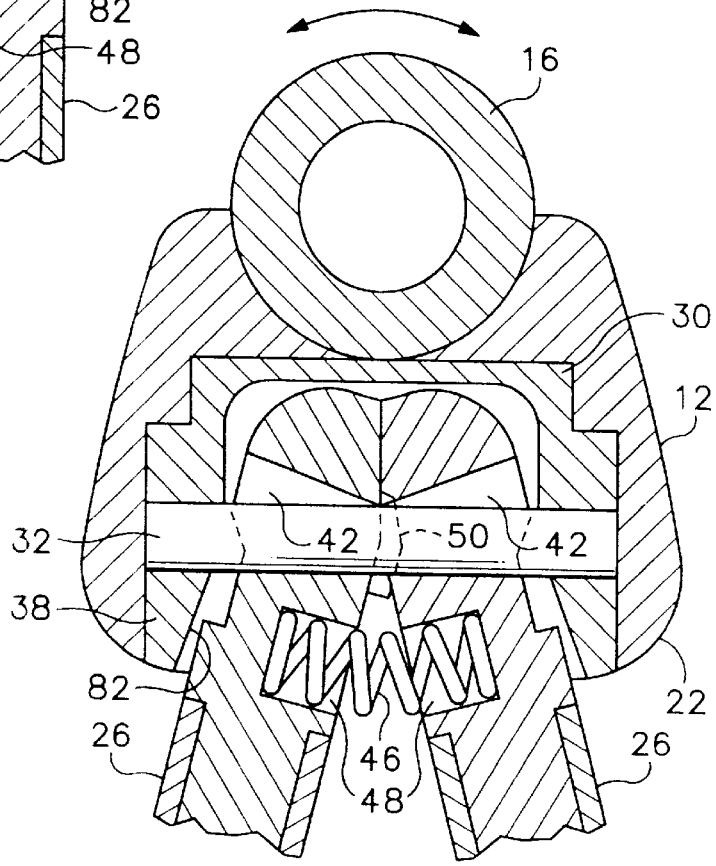
FIG. 3B is a cross sectional view taken along the line 3—3 of FIG. 1, in which the supports are spread apart.
Figure 4:
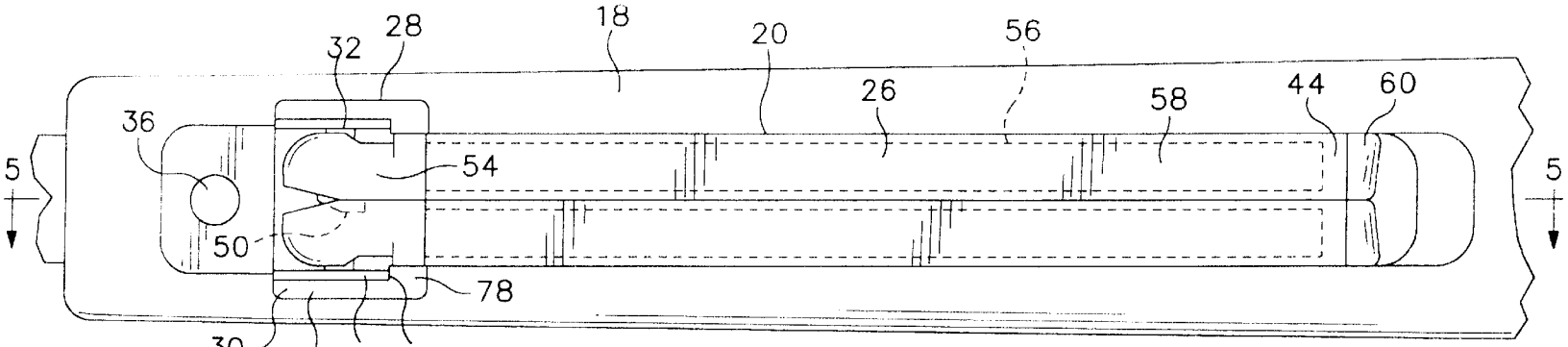
FIG. 4 is a view of the lower portion of the stock looking up toward the barrel.

The pivot mechanism may be any conventional mechanical system which allows the supports 26 to pivot or move selectively from an extended position (shown in FIG. 1) to a retracted position (shown in FIG. 4). Referring now especially to FIGS. 3A and 3B, in one embodiment, the pivot mechanism is comprised of a block 30 of polymeric material having a metal rod 32. The slot 20 at one end has a cut-out portion 28 that is slightly wider than the majority of the slot 20 so as to receive the block 30. The block 30 attaches to the stock 12 by means of a bolt 34 which may be connected to a swivel stud 36. The block 30 has sidewalls 38 at either side, each of which has a bore 40 for receiving an end of the rod 32. The rod 32 passes through bores 42 in the ends of the supports 26. Each support 26 thus is capable of pivoting about the rod 32, so that each support 26 may be pivoted from the retracted position in the slot 20 to the fully extended position supporting the firearm 10, as shown in FIG. 1.

In another preferred aspect of the invention, the supporting system 24 has a spreading mechanism between the two supports 26. The spreading mechanism urges the supporting ends 44 of the two supports 26 outward from each other when the supports 26 are pivoted into an extended position, as illustrated in FIG. 2. Referring to FIGS. 3A and 3B, the spreading mechanism in one embodiment is a coil spring 46. Each end of the spring 46 is located within a cavity 48 in each respective support 26. The spreading mechanism could alternatively be a different type of spring, such as a leaf spring, or a mechanical device such as a bar or rod or set of hinged members used to urge or maintain the two supports 26 apart from each other. When the supports 26 are in the extended position, spreading the two supports 26 apart from each other adds stability to the supporting system 24 so that the two supports 26 provide greater stability for the firearm 10.

In another aspect of the invention, the supports 26 preferably engage or are connected to each other so that retracting one of the supports 26 retracts both at the same time. In one embodiment, each of the supports 26 has a protruding ridge 50 and a slot 52 located at the pivoting end 54 of the support 26. A ridge 50 of one support 26 is located opposite the slot 52 of the other support 26, so that each ridge 50 fits within a corresponding slot 52 thus engaging the two supports 26 with one another. The ridges 50 and slots 52 are shaped to allow the supporting ends 44 to be spread apart yet allow a close fit between the two pivoting ends 54 of the supports 26. Thus the slots 52 have sufficient depth to accommodate each ridge 50 when the supports are spread apart as in FIG. 3B. Alternatively, the two supports 26 may be connected by rods or pins interconnecting the two supports 26. Nevertheless, the supports 26 may be each individually secured to the pivot mechanism so that each pivots individually.

While a supporting system has been described having two supports 26, it is within the scope of the invention to also include supporting systems having more or fewer supports 26. Thus, it would be possible to employ a supporting system having a single support 26 to support the firearm 10. It is also within the scope of the invention to include other supports 26, such as a tripod supporting system.

In another aspect of the invention, the supporting system is retained within the slot 20 when the supports 26 are retracted within the slot as in FIG. 4. This may be accomplished in a variety of fashions. In one embodiment, the spring 46 between the supports 26 urges the supports 26 apart from each other. When the supports 26 are retracted into the slot 20, the spring 46 urges the supports 26 toward the interior walls of the slot 20, so that the supports 26 frictionally engage the walls of the slot 20. Other systems may be employed to retain the supports 26 within the slot 20. For example, a separate mechanical locking mechanism could be used to securely lock the supports 26 into the slot 20. Alternatively, the stock 14 could be molded so that the slot 20 is narrower at the opening of the slot 20 than the combined thickness of the supports 26, so as to engage the supports 26 when the supports 26 are retracted into the slot 20. Alternatively, the interior walls of the slot 20 could have ridges or protrusions to engage the supports 26.

In another aspect of the invention, the length of the supports 26 is adjustable. The length of the supports 26 may be adjusted by providing multiple support extension members. For example, a support 26 may be comprised of an outer support member and an inner support member so that the length of the support 26 may be adjusted by pulling the inner support member from out of the outer support member. The multiple support extension members of a support may be secured to each other by any conventional means, such as friction turn locks, pins, levers, or ratchets.

Figure 5:
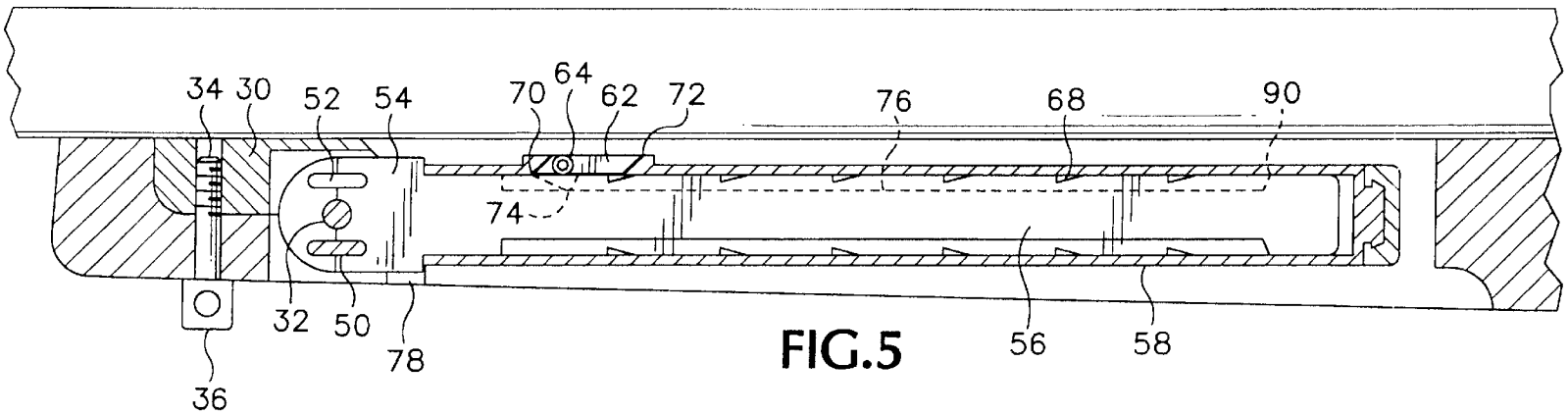
FIG. 5 is a cross sectional view taken generally along the line 5—5 of FIG. 4.
Figure 6:
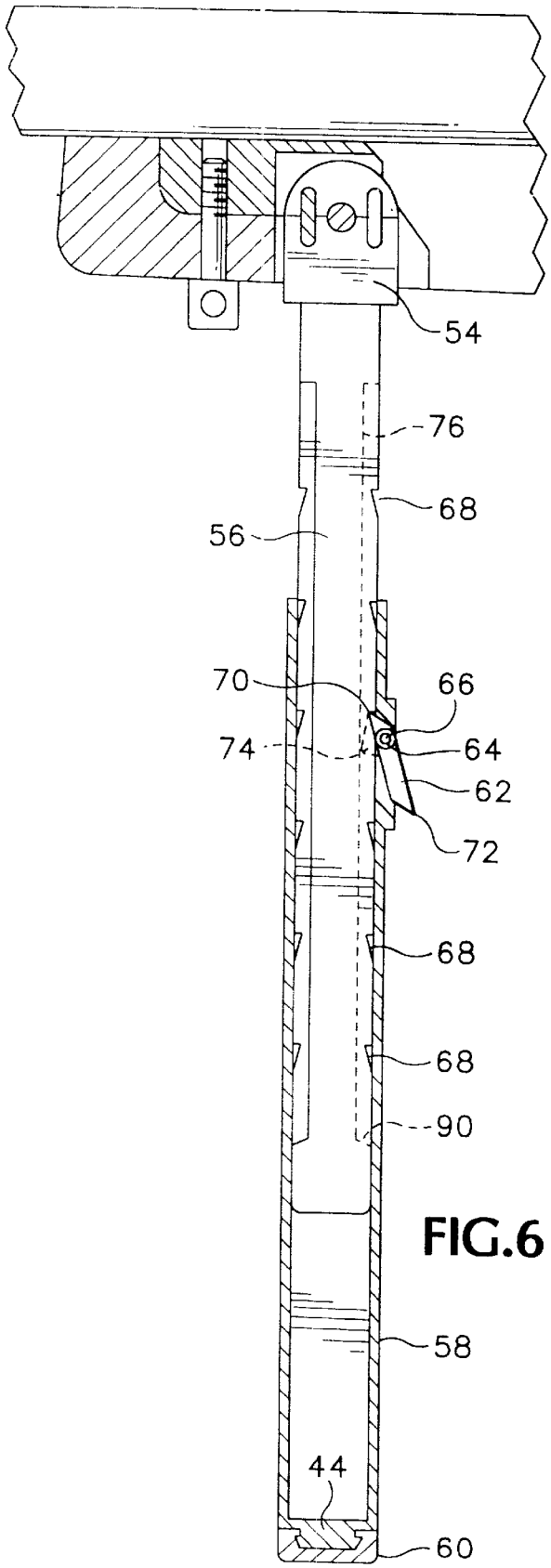
FIG. 6 is a cross sectional view of an exemplary support having an extension member.

For example, referring now especially to FIGS. 5 and 6, in one preferred aspect of the invention, each support 26 is comprised of an inner member 56 and outer member 58. The inner member 56 fits within the outer member 58. The outer member 58 moves relative to the inner member 56 so as to adjust the length of the support 26 by adjusting the relative positions of the inner member 56 and outer member 58 with respect to each other. The inner member 56 is secured at the pivot end 54 to the rod 32. The outer member 58 has at the supporting end 44 a rubber foot 60 to provide additional frictional engagement with a supporting surface.

The inner member 56 and outer member 58 are secured to each other by means of a ratcheting lever 62. The ratcheting lever 62 is mounted on the outer member 58 and contains a spring 64 which urges the ratcheting lever 62 to pivot about a pin 66. The inner member 56 defines a series of notches 68 which are spaced apart along the length of the inner member. 56. The spring 64 urges a locking tip 70 on the ratcheting lever 62 inward toward the notches 68 so that when the locking tip 70 is adjacent to a notch 68, the locking tip 70 engages the notch 68. This prevents the outer member 58 from moving in a direction toward the pivot end 54 of the inner member 56, but does not prevent the outer member 58 from being further extended away from the stock 12 relative to the inner member 56. Thus, this aspect of the present invention allows the support 26 to be quickly extended to selected lengths and secured without the need to physically secure the support 26 by means of a friction turn lock.

In order to retract the outer member 58 relative to the inner member 56, the rear portion 72 of the ratcheting lever 62 is depressed so that the locking tip 70 is rotated so as not to engage any of the notches 68 (for example, as shown in FIG. 5). When the ratcheting lever 62 is in this position, the outer member 58 may be moved inward toward the pivot end 54 of the inner member 56. In order to prevent the outer member 58 from becoming separated from the inner member 56, the ratcheting lever 62 further comprises a detent 74 which extends into a slot 76 defined by the inner member 56. When the outer member 58 is fully extended relative to the inner member 56, the detent 74 abuts the end 90 of the slot 76 of the inner member 56, preventing further extension of the outer member 58 relative to the inner member 56. Alternatively, extension of the outer member 58 relative to the inner member 56 could be accommodated by providing a pin in the outer member 58 instead of the detent 74 or by other alternative mechanical means for preventing the outer member 58 from becoming separated from the inner member 56.

In another aspect of the invention, the supporting system 24 allows the supports 26 to be locked into a fully extended position as in FIG. 1. When the supports 26 are locked in the extended position, the supports 26 are restrained from pivoting back into the slot 20. In one embodiment, the supports 26 are locked into position as follows. Referring now especially to FIG. 4, each sidewall 38 of block 30 has a front portion 78 that defines an edge 80. Each sidewall 38 also defines an inclined surface 82 which is inclined so as to slant inward toward the interior of the slot 26. (See also FIG. 3A.) When the supports 26 are fully extended, as shown in FIG. 3A, the supports 26 are each located past the edge 80 of the front portion 78 so that each support 26 may spread apart from each other toward the corresponding inclined surface 82 as shown in FIG. 3B. The edge 80 prevents the supports 26 from being retracted or pivoting back into the slot 20. Similarly, other mechanical catch mechanisms may be employed in order to resist movement of the supports 26 back toward the slot 20 once fully extended to the position shown in FIG. 1.

In yet another aspect of the invention, the supporting system 24 allows the stock 12 to be canted relative to the supports 26. Referring now especially to FIGS. 3A and 3B, each bore 42 in the pivot end 54 of each support 26 is shaped so that the bore is narrower at the interior side of the support 26 and wider at the exterior side of the support 26. In addition, the supports 26 are sized so that when spread apart, as shown in FIG. 3B, there remains a gap between the inclined surface 82 of the block 30 and the supports 26. Accordingly, the bores 42 and inclined surfaces 82 allow the stock 12 to be canted relative to the supports 26 as shown by the arrow in FIG. 3B. In other words, the stock 12 may be pivoted relative to the supports 26 about an axis parallel to the firearm barrel 16 while the supports 26 remain motionless. Thus, a shooter may by canting the stock 12 make small adjustments in the position of the firearm 10 while the supports 26 remain stationary. Alternatively, canting could be accommodated by providing an additional pivoting mechanism between the block 30 and the stock 12, or in another mechanical fashion.

The supporting system of the present invention may be constructed of any conventional material, such as metal, wood, fiberglass or carbon fiber material. Preferably, the stock 14 is injection molded from a polymeric material such as Service Polymers Polypropylene CPPFG18CBK. Similarly, the supports 26 may be constructed out of any material such as metal, wood, fiberglass or carbon fiber material, but are preferably injection molded, such as from Allied Signals Capron Nylon 8234. Polymeric materials are preferred because they are light weight. Supporting systems made from polymeric materials generally generate less noise than traditional bipods since they do not involve the use of metal parts, which tend to generate noise when the various pieces are moved with respect to each other.

The various aspects of the invention thus provide significant advantages by providing a supporting system that retracts within the slot 20 of the front portion of the stock 14. The present invention allows at least a majority of the external features of a supporting system to be retracted which would otherwise catch on gun cases, brush, clothing or barbed-wire fences, etc. Because the supporting system does not clamp onto the exterior of the firearm barrel, it does not impair the shooting accuracy of the firearm. Further, the supporting system has distinct advantages in that it is always available for use with the firearm, because it is always secured to the firearm but may be easily retracted and folded out of the way when not in use. The supporting system also does not detract from the aesthetics of the firearm, because when retracted it does not adversely alter the exterior contours of the stock.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A firearm stock having a supporting system for use with a firearm, comprising:

(a) a stock capable of supporting a firearm barrel on an upper portion of said stock, said stock having a lower portion defining an elongate slot;

(b) at least one support pivotally connected to said stock;

(c) said support movable between a first position in which a majority of said support is located within said slot, and a second position in which a supporting end of said support extends away from said stock so as to support said stock when using said firearm; and (d) wherein said stock is movable relative to said support about a longitudinal axis that is parallel to the barrel of the firearm supported by said stock.

2. The firearm stock of claim 1 further comprising a second support pivotally connected to said stock and movable between said first position and said second position.

3. The firearm stock of claim 1 wherein said support includes an extension member.

4. The firearm stock of claim 1 wherein said support in said first position is contained completely within said slot.

5. The firearm stock of claim 1 wherein said support is sized so that said support is substantially flush with the exterior of said stock when said support is in said first position.

6. The firearm stock of claim 2 further including a spreading mechanism between said supports.

7. The firearm stock of claim 2 wherein said supports are engaged with one another so that retracting one of said supports retracts both supports at the same time.

8. The firearm stock of claim 1 wherein said supporting system resists movement of said support from said first position to said second position when said support is in said first position.

9. The firearm stock of claim 1 wherein the length of said support is adjustable.

10. The firearm stock of claim 1 wherein said support is comprised of at least two members so as to vary the length of said support.

11. The firearm stock of claim 1 wherein said supporting system resists movement of said support from said second position to said first position when said support is in said second position.

12. A firearm stock having a supporting system for use with a firearm, comprising:

(a) a stock capable of supporting a firearm barrel on an upper portion of said stock, said stock having a lower portion having a pair of sidewalls defining an elongate slot therebetween;

(b) a pair of supports pivotally connected to said stock;

(c) each of said supports movable between a first position in which a majority of said support is located within said slot, and a second position in which a supporting end of said support extends away from said stock so as to support said stock when using said firearm;

(d) a spreading mechanism connected to each of said supports, said spreading mechanism being mounted between said supports and located within said slot when said supports are in said first position; and (e) an extension member moveable in an inward and outward direction, each of said supports having a ratcheting lever and a biasing mechanism, said biasing mechanism urging said ratcheting lever to selectively resist movement of said extension member in said inward direction, and said extension member being free from resistance from said ratcheting lever during movement in said outward direction.

13. The firearm stock of claim 12 wherein said supports are in contact with one another when in said first position.

14. The firearm stock of claim 12 further comprising means for locking said support in said second position, said means for locking said support being located within said slot.

15. The firearm stock of claim 12 wherein said supports in said first position are contained completely within said slot.

16. The firearm stock of claim 12 wherein said supports are sized so that said supports are substantially flush with the exterior of said stock when said supports are in said first position.

17. The firearm stock of claim 12 wherein said supports are engaged with one another so that retracting one of said supports retracts both supports at the same time.

18. The firearm stock of claim 12 wherein said stock and said supports are formed from polymeric material.

19. The firearm stock of claim 12 wherein said supporting system is attached to said stock by a bolt connected to a swivel stud.

20. The firearm stock of claim 12 wherein said support frictionally engages the walls of said slot to resist movement from said first position toward said second position.

* * * * *